US006552711B1

(12) United States Patent
Nakamura

(10) Patent No.: US 6,552,711 B1
(45) Date of Patent: Apr. 22, 2003

(54) DISPLAY DEVICE AND INFORMATION TERMINAL

(75) Inventor: Masafumi Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 190 days.

(21) Appl. No.: 09/685,932

(22) Filed: Oct. 11, 2000

(30) Foreign Application Priority Data

Oct. 13, 1999 (JP) ..... 11-290518

(51) Int. Cl.[7] ..... G09G 3/36

(52) U.S. Cl. ..... 345/102; 345/88; 345/98; 345/102; 345/202; 345/100

(58) Field of Search ..... 345/102, 88, 87, 345/100, 98, 202

(56) References Cited

U.S. PATENT DOCUMENTS 5,731,794 A * 3/1998 Miyazawa ..... 345/88

* cited by examiner

*Primary Examiner*—Richard Hjerpe
*Assistant Examiner*—Ali Zamani
(74) *Attorney, Agent, or Firm*—Sughrue Mion, PLLC

(57) ABSTRACT

A color image synthesized with three primary color images is outputted to a plane illuminated by a back light by controlling amounts of transmission of the three primary color lights and a monochromatic image is outputted by controlling an amount of transmitted light. When the monochromatic image is displayed, color image reproducing means is not driven. A monochromatic image can be displayed on a color image displayed.

1 Claim, 6 Drawing Sheets

DISPLAY DEVICE AND INFORMATION TERMINAL

CROSS REFERENCE TO RELATED APPLICATIONS

The present invention claims priority from Japanese Patent Application No. 11-290518 filed Oct. 13, 1999, the contents of which are incorporated herein by reference.

BACKGROUND OF THE INVENTION

1. Field of the Invention

The present invention relates to a display device capable of displaying a color image and an information terminal using the same display device and, particularly, to a display device for displaying an image by using liquid crystal and an information terminal such as portable telephone set in which the same display device is incorporated to display an information.

2. Description of Related Art

With the development of the digital technology and the communication technology, the multi-media industries handling data containing moving picture and voice have been expanding at high rate. For example, most of electronic devices such as portable telephone sets and mobile personal computers can be connected to other electronic devices or servers through cables or radio wave to take in or transmit various information. In the following description, not only the portable telephone set or PHS (Personal Handy-phone System) but also all of electronic devices functioning as terminals will be defined as information terminals and the term "information terminal" will be used in the above meaning.

Most of the information terminals include displays as devices for displaying information visually. Although a CRT (Cathode Ray Tube) has been used mainly for that purpose, there is a problem that the CRT is large in not only space occupation but also power consumption. In view of this fact, a liquid crystal display has been used in a portable information terminal driven by a battery. The liquid crystal display is featured by that it is possible to substantially reduce power consumption compared with the CRT.

Among the liquid crystal displays, a monochromatic liquid crystal display is advantageous compared with a color liquid crystal display in that the power consumption can be reduced substantially. The reason for this is that a drive circuit for a monochromatic display is simple enough to display a monochromatic image and, when a fine gradation of image is not required, the drive circuit can be further simplified. Further, it may be possible to eliminate a back-light for enabling a display even in a dark area.

On the contrary, in a display for displaying a color image, the image is displayed by using three primary colors RGB (Red, Green and Blue). Therefore, drive circuits corresponding to these primary colors are required, whose circuit constructions become complicated and consume power correspondingly when many tones are to be displayed. Further, in order to display an image with natural color including many color tones, it is necessary to always light a back-light for illuminating a rear side of liquid crystal with enough brightness thereof. In view of this fact, it is usual to use the monochromatic liquid crystal display in a device such as portable telephone set which is small in size and whose battery capacity is small.

FIG. 7 shows an example of a construction of a color liquid crystal display for use in a portable telephone set as a conventional information terminal capable of receiving multi-media, which is disclosed in JP-A 6-301032, color liquid display 100 is constructed with color light radiation source 101, liquid crystal display panel 102 and liquid crystal shutter 103 arranged between color light sources 101 and liquid crystal display panel 102. Color light radiation source 101 is constructed with color light sources 101R, 101G and 101B such as fluorescent lamps, tungsten lamps or CFL tubes corresponding to the three primary colors. In a case where these light sources are candescent light sources, three primary color filters are provided in front of these light sources, respectively. When color light sources 101R, 101G and 101B are ON/OFF controlled frequently corresponding to colors of an image, there is a problem that the life of color light radiation source 101 composed of fluorescent lamps, etc., is shortened. When the color light radiation source 101 is composed of tungsten lamps, there is a problem that the response to a color change is degraded.

In view of these problems, liquid crystal shutters 103R, 103G and 103B are arranged correspondingly to respective color light sources 101R, 101G and 101B and ON/OFF controlled. Lights selectively passed through liquid crystal shutters 103R, 103G and 103B radiate liquid crystal display panel 102 and a desired color image is displayed by synthesis of these three primary colors.

As mentioned above, in conventional color liquid crystal display 100, all of color light sources 101R, 101G and 101B corresponding to the respective three primary colors are lit when a color display is performed. This is also true when a monochromatic display is performed. Therefore, there is a problem that the power consumption of color liquid crystal display 100 is substantially increased compared with the display, which can display only monochromatic image.

FIG. 8 shows a construction of a display portion of an information terminal having reduced power consumption. Display portion 120, which is disclosed in JP-A 10-63196, is constructed with color liquid crystal portion 121 and monochromatic liquid crystal portion 122. Color liquid crystal portion 121 displays only moving image with color and monochromatic liquid crystal portion 122 displays other images. Therefore, when other information such as text information than a moving image information is displayed, monochromatic liquid crystal portion 122 is used and light sources of color liquid crystal portion 121 are turned OFF to reduce the power consumption.

FIG. 9 is a perspective view of another example of an information terminal having reduced power consumption, showing an outer configuration thereof and FIG. 10 is a side view of the same information terminal. In these figures, information terminal 131 includes main body portion 133 on a surface of which keyboard 132 is provided and cover portion 134. As shown in FIG. 10, cover portion 134 is hinged about rotary joint portion 135 such that either one of surfaces thereof can be looked from the side of keyboard 132. Color liquid crystal portion 136 is incorporated in one of the surfaces of cover portion 134 and monochromatic liquid crystal portion 137 is incorporated in the other surface. A display drive portion, which is not shown, provided within main body portion 133 performs a display control such that only one of the liquid crystal portions, which faces to the side of keyboard 132, is activated. Therefore, a user of information terminal 131 wishes a color image display, he turns cover portion 134 to provide color liquid crystal portion 136 on the side of keyboard 132. When the user wishes to see a monochromatic image in order to reduce power consumption or for other reasons, he turns the cover portion to provide monochromatic liquid crystal portion 137 on the keyboard side.

As described, since, in the case of color liquid crystal display 100 shown in FIG. 7, it is impossible to reduce power consumption even when the monochromatic display is performed, it has been usual to reduce power consumption by providing the color liquid crystal display portion and the monochromatic liquid crystal display portion as shown in FIG. 8 or FIG. 10. With such construction, it becomes unnecessary to light all of the light sources for the three primary colors for the monochromatic display to thereby make a use of one kind of light source such as candescent light source possible. However, since either one of the prior art information terminals has to equip with two kinds of liquid crystal displays, there is a problem that the manufacturing cost of the information terminal is substantially increased.

Further, in the information terminal shown in FIG. 8, it is necessary to arrange color liquid crystal portion 121 and monochromatic liquid crystal portion 122 in an upper portion of the main body thereof. Therefore, there is a problem that, although it is necessary to increase the size of the information terminal or reduce the sizes of liquid crystal portions 121 and 122, the usability of the information terminal is degraded.

In the case of information terminal 131 shown in FIG. 9 and FIG. 10, since the liquid crystal portion can be rotated by rotary joint portion 135, it is possible to make the information terminal itself compact. However, since the liquid crystal portion, which is not used, is exposed externally, there is a possibility of that portion damaged. Further, further, sine it is necessary to rotate cover portion 134 every time when the image display is switched between the color display and the monochromatic display, there is a problem that the switching operation is troublesome.

SUMMARY OF THE INVENTION

An object of the present invention is to provide a display device capable of displaying both a color image and a monochromatic image by means of a single display while reducing power consumption for the monochromatic image display and an information terminal using the same display device.

According to a first aspect of the present invention, a display device comprises:

(1) a back light as a light source for illuminating a predetermined surface from a back side thereof;

(2) color image reproducing means arranged on the surface illuminated by the back light, for outputting a color image synthesized with three primary colors by controlling amounts of transmission of the three primary color lights in respective two dimensional areas corresponding to an image signal; and (3) monochromatic image reproducing means arranged on the surface illuminated by the back light, for outputting a monochromatic image by controlling an amount of transmission of light in respective two dimensional areas corresponding to an image signal.

That is, on the surface illuminated by the back light, the color image reproducing means outputting a color image synthesized with three primary colors by controlling amounts of transmission of the three primary color lights in respective two dimensional areas corresponding to an image signal and the monochromatic image reproducing means for outputting a monochromatic image by controlling an amount of transmission of light in respective two dimensional areas corresponding to an image signal arranged and, when the monochromatic image is displayed, the color image reproducing means is not driven. Further, even when a color image is displayed, a monochromatic image display can be simply combined with the color image.

The color image reproducing means and the monochromatic image reproducing means are transmission type liquid crystals having reflection type characteristics concurrently and the display device can further comprise back light drive control means for extinguish the back light except when a color gradation display is performed. With such back light drive control means, it is possible to reduce power consumption by extinguishing the back light in even color image display except the case where the color image is displayed with gradation.

Each of the color image reproducing means and the monochromatic image reproducing means may comprise a display electrode group composed of three kinds of rod like color electrodes for independently controlling displays of the respective R, G and B colors and one kind of rod like monochromatic display electrode for controlling a display of a monochromatic image, which are repeatedly arranged in predetermined directions on a common plane, a gate electrode group composed of a plurality of parallel gate electrodes arranged in a direction crossing the directions of the respective electrodes constituting the display electrode group with a predetermined interval and liquid crystal filling a space between the display electrode group and the gate electrode group. By repeatedly arranging four kinds of electrodes, that is, R, G and B color electrodes and the monochromatic electrode, a display control of each pixel becomes possible by a matrix arrangement of the pixels and the gate electrodes.

According to a second aspect of the present invention, an information terminal using the display device according to the first aspect of the present invention comprises:

(1) a display device including a back light as a light source for illuminating a predetermined surface from a back side thereof, color image reproducing means arranged on the surface illuminated by the back light, for outputting a color image synthesized with three primary colors by controlling amounts of transmission of the three primary color lights in respective two dimensional areas corresponding to an image signal and monochromatic image reproducing means arranged on the surface illuminated by the back light, for outputting a monochromatic image by controlling an amount of transmission of light in respective two dimensional areas corresponding to an image signal;

(2) receiving means for receiving data;

(3) data separation means for separating the data received by the receiving means to sound data and image display data; and (4) display data separation means for further separating the image display data separated by the data separation means to message data represented by binary value and color data representing respective primary colors and supplying the message data and the color data to the display device as an image signal for monochromatic image and an image signal for color image.

In this information device, the received data is separated to the sound data and the image display data and the image display data is further separated to the message data represented by binary value and the color data representing the three primary colors and supplied to the display device. With this construction, it is possible to perform a control for superposing message on a color image easily.

BRIEF DESCRIPTION OF THE DRAWINGS

Specific embodiments of the present invention will now be described, by way of example only, with reference to the accompanying drawings, in which.

DETAILED DESCRIPTION OF THE PREFERRED EMBODIMENTS

The present invention will be described in detail with reference to preferred embodiments thereof, which are shown in the accompanying drawings.

Figure 1:
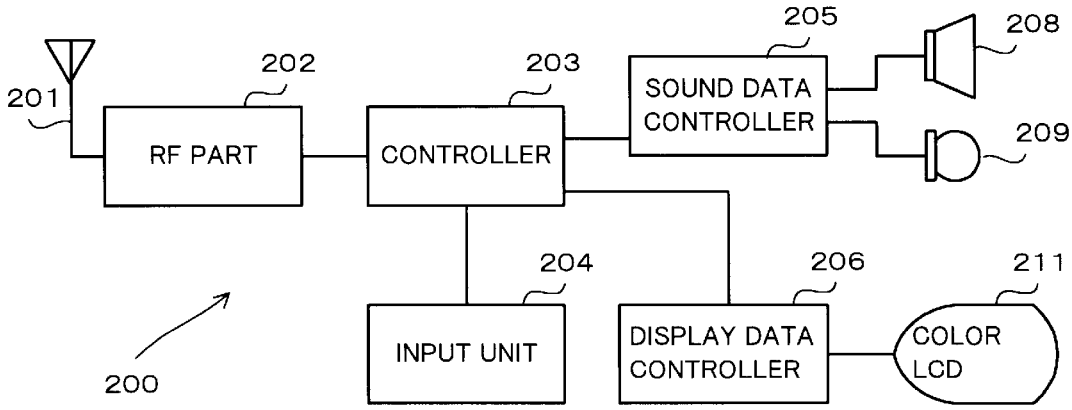
FIG. 1 is a block circuit diagram, schematically showing a construction of an information terminal using a display device according to a first embodiment of the present invention.

FIG. 1 is a block circuit diagram, schematically showing a construction of an information terminal using a display device according to a first embodiment of the present invention. Information terminal 200 includes RF (Radio Frequency) part 202 having antenna 201. Controller 203 controls a transmission/receiving of RF signal by RF part 202. Controller 203 is connected to input unit 204 for inputting a dial information and other information, sound data controller 205 for controlling a sound data and display data controller 206 for controlling display data. Sound data controller 205 is connected to receiver 208 for converting sound data into sound output and microphone 209 for inputting sound and performs an input/output control of sound data. Display data controller 206 is connected to color liquid display (LCD) 211 to control a color display and a monochromatic display.

Controller 203 includes a CPU (Central Processing Unit), which is not shown. The CPU is connected to buses such as data bus, etc., (not shown) and performs predetermined control operations based on programs stored in a ROM (Read Only Memory) or other memory medium.

Figure 2:
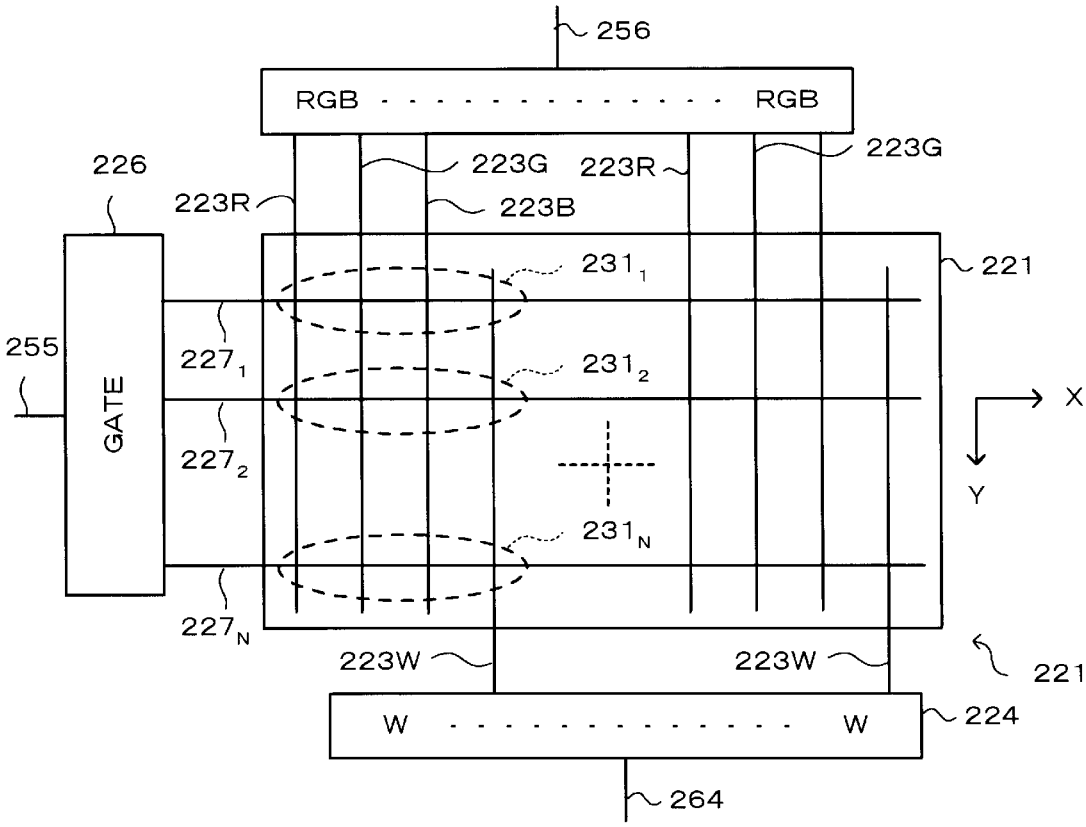
FIG. 2 shows an electrode arrangement which is a main portion of a color liquid crystal display according to the first embodiment.

FIG. 2 shows a main portion of the color liquid crystal display according to this embodiment. Main body portion 221 of color liquid crystal display device 211 includes red (R), green (G) and blue (B) electrodes 223R, 223G and 223B led out from color electrode portion 222 and white electrode 223W led out from monochromatic electrode portion 224 are arranged as an electrode unit and a plurality of the electrode units are arranged in parallel repeatedly in a direction X with a predetermined interval. N gate electrodes $\mathbf{227}_1$ to $\mathbf{227}_N$ led out from gate electrode portion 226 are arranged in parallel in direction Y perpendicular to these electrode units arranged in direction X with a predetermined interval which is the same as or different from that of the interval of the electrode unit. These electrodes 223R, 223G, 223B, 223W and 227 constitute a matrix for displaying respective pixels.

The electrode unit including electrodes 223R, 223G, 223B and 223W outputs an image signal having a level corresponding to a tone of a pixel among pixels in respective lines in the X axis direction, which displays an image, while holding the image signal for a constant time t. A voltage is applied to one of gate electrodes 227 led out from gate electrode portion 226 for this constant time t. In a next constant time t, similar voltage is applied to a next one of the gate electrodes 227 and a next image signal for display is supplied to the electrode unit, and so on.

In a case where a color image is displayed, however, a voltage corresponding to a signal level of 8-bits (256 tones) is merely applied to respective electrodes 223R, 223G and 223B led from Color electrode portion 222 and no voltage is applied to monochromatic electrode 223W led out from monochromatic electrode portion 224. On the contrary, in a case where a monochromatic image is displayed, a voltage corresponding to one of two signal levels (ON and OFF) of 1-bit is applied to electrode 223W and no voltage is applied to color electrodes 223R, 223G and 223B.

Although not shown in FIG. 2, a back light is provided in a portion corresponding to display main body portion 221 to radiate incandescent light during a time in which the back light is ON. In this embodiment, the back light is turned ON in only the color display with gradation.

Regions $\mathbf{231}_1$ to $\mathbf{231}_N$ indicated by dotted circles in FIG. 2 indicate the pixel areas in the leftmost line. Sequential display of a color image and a monochromatic image will be described with reference the pixel areas in the leftmost line.

Figure 3:
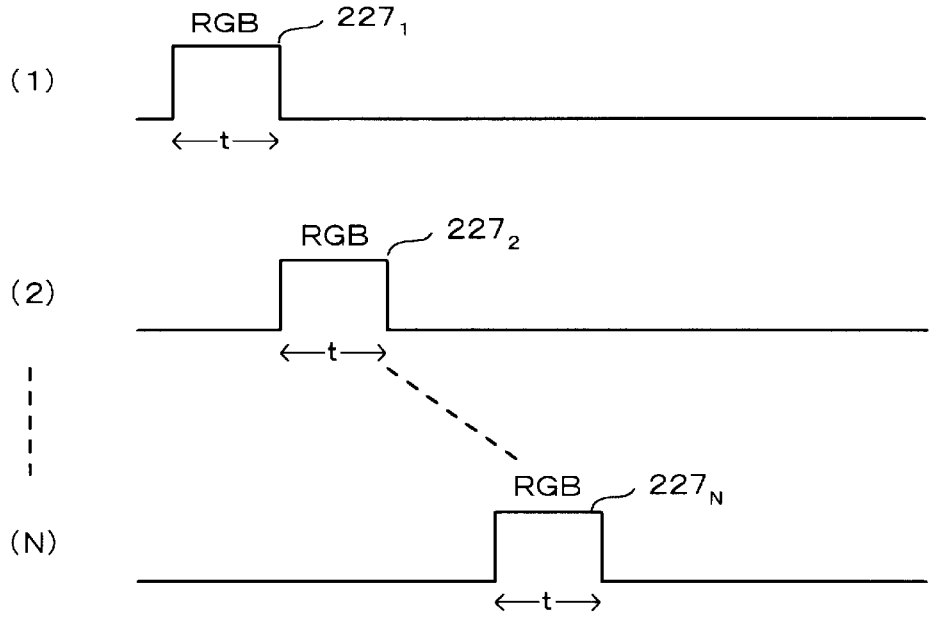
FIG. 3 is a timing chart showing signal application of a signal when a color image is displayed in the first embodiment.

FIG. 3 shows the case where the color image is displayed. As shown by a waveform (1) in FIG. 3, the voltage is applied to first gate electrode $\mathbf{227}_1$ in the first constant time t. When voltages having signal levels corresponding to the three primary colors are applied to color electrodes 223R, 223G and 223B in this time period, the image of first region $\mathbf{231}_1$ is displayed based on a balance of transmitting light from the back light, which is not shown. Then, as shown by a waveform (2), a voltage is applied to second gate electrode $\mathbf{227}_2$ in the next constant time period and, with the application of voltages having signal levels corresponding to the three primary colors to color electrodes 223R, 223G and 223B in the next constant time, the image of second region $\mathbf{231}_2$ is displayed based on a balance of transmitting light from the back light, and so on. It is practical that such display is performed for the respective color electrode units each including color electrodes 223R, 223G and 223B and arranged in parallel in the X direction.

Figure 4:
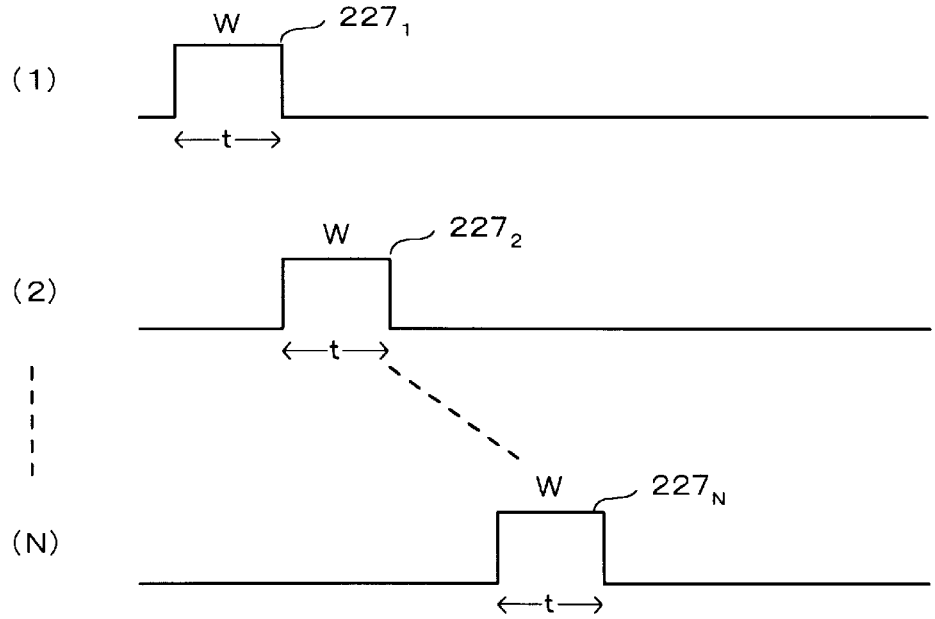
FIG. 4 is a timing chart showing signal application of a signal when a monochromatic image is displayed in the first embodiment.

FIG. 4 shows the case where the monochromatic image is displayed. As shown by a waveform (1) in FIG. 4, the voltage is applied to first gate electrode $\mathbf{227}_1$ in the first constant time t and, when a voltage having a signal level corresponding to the monochromatic image is applied to electrode 223W in this time period, the image of first region $\mathbf{231}_1$ is monochromatically displayed based on a balance of transmitting light from the back light. Then, as shown by a waveform (2), a voltage is applied to second gate electrode $\mathbf{227}_2$ in the next constant time t and, with the application of a voltage having a signal level corresponding to the monochromatic image to electrode 223W in the next constant time, the image of second region $\mathbf{231}_2$ is monochromatically displayed based on a balance of transmitting light from the back light, and so on. It is practical that such display is performed for respective electrodes 223W which are in parallel in the X direction.

Figure 5:
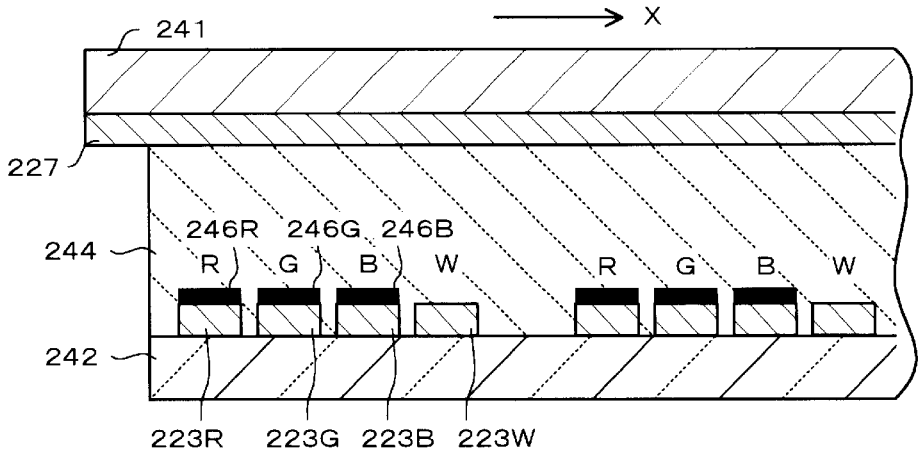
FIG. 5 is a cross section showing a cross sectional structure of a main portion of the display device shown in FIG. 2.

FIG. 5 shows a cross sectional structure of the main body portion of the display shown in FIG. 2. Main body portion 221 includes glass substrates 241 and 242 on an uppermost portion and a lowermost portion thereof, respectively. Gate electrodes 227 are arranged below uppermost glass substrate 241 such that the gate electrodes become in parallel to a drawing sheet and the color electrode units each including color electrodes 223R, 223G and 223B are arranged on lowermost glass substrate 242 such that the color electrode units become perpendicular to the drawing sheet. A space between gate electrodes 227 and the color electrode units is filled with liquid crystal 244 for controlling the transmitting amount of light from the back light. Liquid crystal 244 has the light transmitting type characteristics as well as the reflection type characteristics.

On color electrodes 223R,. 223G and 223B of the color electrode units, filters 246R, 246G and 246B having colors for transmitting red (R) light, green (G) light and blue (B) light are provide, respectively, and, by selecting wavelength of light to be outputted from the back light, desired color lights are outputted by transmission. In the case of monochromatic display electrodes 223W, there is no filter provided since a monochromatic image is displayed.

Figure 6:
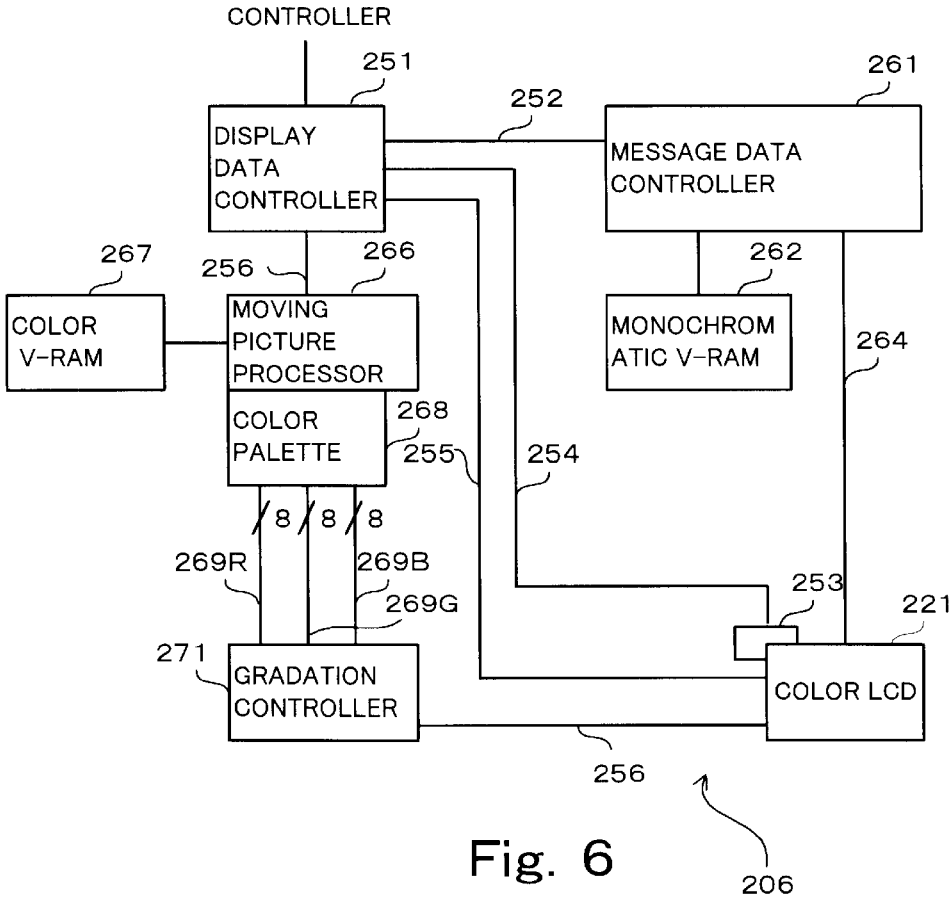
FIG. 6 is a block diagram showing a practical construction of a display data control portion of this embodiment.
Figure 7:
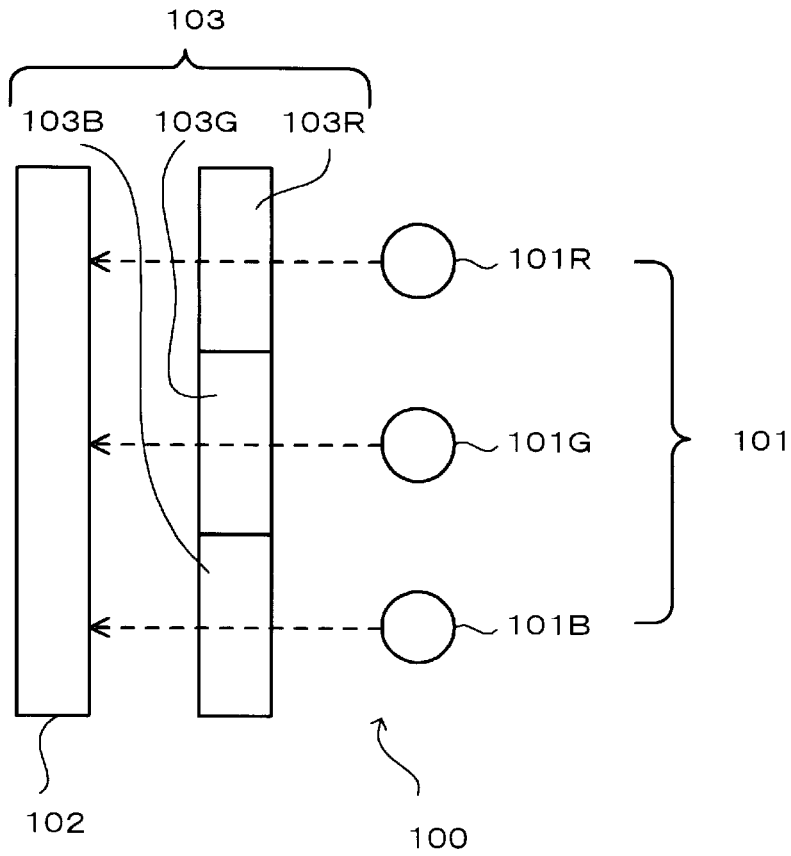
FIG. 7 shows an example of a construction of a color liquid crystal display of a portable telephone set as a conventional information terminal capable of receiving multi-media.
Figure 8:
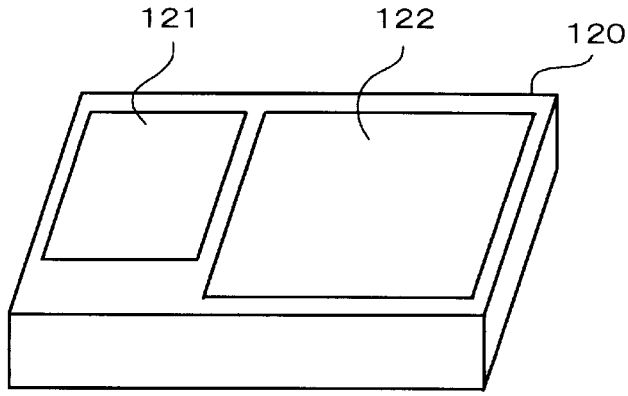
FIG. 8 is a perspective view of a construction of a display portion of an information terminal power consumption of which is reduced.
Figure 9:
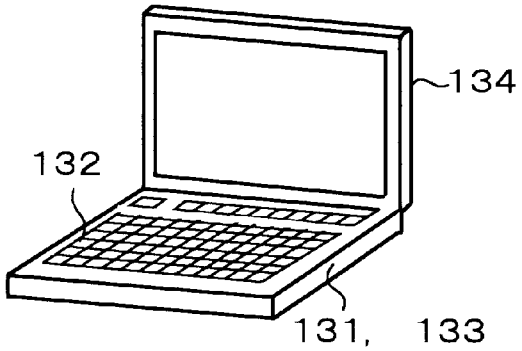
FIG. 9 is a perspective view showing another example of the information terminal, power consumption is reduced.
Figure 10:
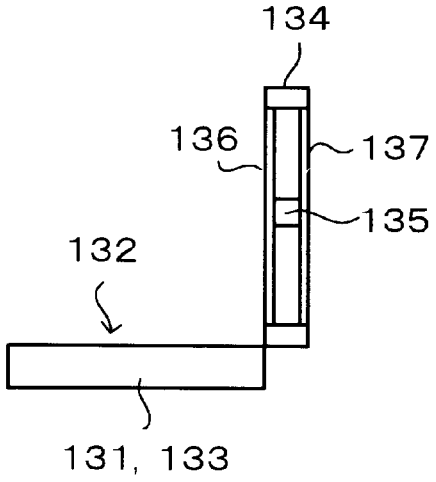
FIG. 10 is a side view of the information terminal shown in FIG. 9.

FIG. 6 shows a practical construction of the display data controller 206 shown in FIG. 1. Display data controller 206 includes display data controller 251, which receives an image data from controller 203 shown in FIG. 1 and outputs a moving picture processing data. Binary display data 252 used in displaying a monochromatic image with binary values, back light signal 254 used to light back light 253, gate control signal 255 for ON/OFF controlling gate electrodes 226 shown in FIG. 2 and color LCD display data 256 to be applied to color electrode units 222 (FIG. 2) are produced on the basis of the moving picture processing data.

Binary display data 252 is supplied to message data controller 261 and a monochromatic image thereof is extended on monochromatic video RAM (Random Access Memory) 262. The binary display data is read out with a reproducing timing thereof and supplied to monochromatic electrodes 224 shown in FIG. 2 as monochromatic binary signals 264.

Color LCD display data 256 is supplied to moving picture processor 266. In moving picture processor 266, color LCD display data 256, which is compressed by, for example, MPEG (Moving Picture Experts Group), is demodulated to a color image having an original gradation by using color palette 268 and extended on color video RAM 267 as color images of respective frames. Then, moving picture processor 266 sends color gradation signals 269R, 269G and 269B each of 8 bits (256 tones) corresponding to red (R), green (G) and blue (B), respectively, to gradation controller 271 with a predetermined timing. Gradation control circuit 271 supplies the color gradation signals to display main body 221 with the controlled timing of gate electrodes 226 as color LCD display data 256. A still picture information representing a color gradation of other image than moving picture is reproduced to 3-color multi-tone data by color palette 262 without processing in moving picture processor 256 and extended on color video RAM 267 similarly.

An operation of the information terminal constructed as mention will be described. In information terminal 200 shown in FIG. 1, the data received at antenna 201 is demodulated in RF part 202 and sent to controller 203. Controller 203 separates the sound data from the received data and sends it to sound data controller 205. As a result, sound is outputted from receiver 208. When the user of information terminal 200 communicates with the other side, his voice inputted from microphone 209 is converted into sound data by sound data controller 205 and is sent to RF part 202 through controller 203. In RF part 203, the sound data is sent to the other side together with other signals on demand.

On the other hand, display data other than sound data, which is received by controller 203 from the RF part 202 or input unit 204, is sent to display data controller 206. In display data controller 206, the display data is classified to color display data and other display data (monochromatic display data) for the purpose of reduction of power consumption of back light 253. If no color display data including color moving picture is outputted, back light signal 254 used to light on back light 253 is turned to an OFF state to substantially reduce power consumption thereof. This is because, in the monochromatic display, it is usually possible to display binary image by reflection of the liquid crystal itself, etc.

In a case where both display data for color moving picture and display data for color still picture are received, it is necessary to provide an environment in which gradation can be displayed and tones can be clearly recognized. In such case, back light 253 should be lit. Therefore, back light signal 254 is switched to an ON state to provide a bright color image.

In this manner, it is possible to superpose a monochromatic information such as characters, etc., on a displayed color image. In such case, monochromatic binary signal 264 is also supplied to monochromatic electrodes 224 shown in FIG. 2. Therefore, the binary information such as white colored characters is displayed on the ordinary color moving or still picture.

In information terminal 200 according to this embodiment, it is also possible to send data of color moving picture, etc., to the other side. In such case, input data from input unit 204 is sent to RF part 202 and transmitted therefrom and the same data is sent to display data controller 206 and displayed on color liquid crystal display 211 for confirmation purpose of the transmitted content. It is, of course, possible to remove the monitoring operation by means of color liquid crystal display 211 in order to reduce power consumption.

Although, in the described embodiment, back light 253 is lit for only display data corresponding to color picture, it may be possible to also light on back light 253 for monochromatic picture. In such case, it is, of course, effective in view of reduction of power consumption to reduce a light amount of the back light to a value lower than that when the gradation is displayed.

Further, in this embodiment, the monochromatic image is represented by binary expression. In a case where monochromatic gradation expression is performed as in multi-tone JPEG (Joint Photographic Experts Group) image, it is, of course, possible to light the back light according to necessity caused by the characteristics of the liquid crystal, etc.

In this embodiment, the monochromatic display is performed by providing the monochromatic electrodes. In a display of the type including three independent light sources for the respective red (R), green (G) and blue (B), it is, of course, possible to reduce power consumption in the monochromatic display without using monochromatic electrodes, by turning only one of the light sources ON.

As described hereinbefore, according to the present invention, it is not necessary to drive the color image reproducing means when a monochromatic image is displayed, so that it is possible to reduce power consumption. Further, it is possible to combine a monochromatic image during a color image is being displayed.

For color image other than that requiring the gradation expression, it is possible to reduce power consumption by extinguish the back light.

Further, by merely add the monochromatic display electrode group to the construction of the color display electrode groups, it is possible to obtain a color display and/or a monochromatic display without changing the construction of the gate electrode group.

Further, by incorporating the described display device in a battery-driven, portable information terminal, it is possible to substantially increase the battery life of the information terminal and to reduce the size of the whole of the information terminal.

What is claimed is:

1. A display device comprising:

a back light as a light source for illuminating a predetermined surface from a back side thereof;

color image reproducing means arranged on said predetermined surface illuminated by said back light, for outputting a color image synthesized with three primary colors by controlling amounts of transmission of the three primary color lights in respective two dimensional areas corresponding to an image signal; and monochromatic image reproducing means arranged on said predetermined surface illuminated by said back light, for outputting a monochromatic image by controlling an amount of transmission of light in respective two dimensional areas corresponding to an image signal, wherein said color image reproducing means and said monochromatic image reproducing means comprise a display electrode group composed of three kinds of rod like color electrodes for independently controlling displays of the respective R, G and B colors and one kind of rod like monochromatic display electrode for controlling a display of a monochromatic image and are repeatedly arranged in predetermined directions on a common plane, a gate electrode group composed of a plurality of parallel gate electrodes arranged in a direction crossing the directions of said respective electrodes constituting said display electrode group with a predetermined interval and liquid crystal filling a space between said display electrode group and said gate electrode group.

* * * * *